United States Patent [19]

Signori

[11] Patent Number: 4,610,099

[45] Date of Patent: Sep. 9, 1986

[54] SHOCK-ABSORBING SHOE CONSTRUCTION

[76] Inventor: Antonio Signori, Rua Vereador Cibelli, 357, Farroupilha RS, Brazil

[21] Appl. No.: 798,377

[22] Filed: Nov. 15, 1985

Related U.S. Application Data

[63] Continuation-in-part of Ser. No. 599,185, Apr. 9, 1984, abandoned.

[30] Foreign Application Priority Data

Sep. 19, 1983 [BR] Brazil ..... 8305086

[51] Int. Cl.[4] ..... A43B 7/06; A43B 13/18; A43B 13/20

[52] U.S. Cl. ..... 36/3 B; 36/29; 36/28

[58] Field of Search ..... 36/3 B, 28, 29, 30 R, 36/32 R, 25 R

[56] References Cited

U.S. PATENT DOCUMENTS

| | | | |
|---|---|---|---|
| 2,605,560 | 8/1952 | Govabault | 36/29 |
| 2,817,163 | 12/1957 | Clark | 36/28 |
| 3,120,712 | 2/1964 | Menken | 36/29 |
| 4,016,662 | 4/1977 | Thompson | 36/29 |
| 4,245,406 | 1/1981 | Landay | 36/32 R |
| 4,316,332 | 2/1982 | Giese et al. | 36/28 |
| 4,391,048 | 7/1983 | Lutz | 36/28 |
| 4,446,634 | 5/1984 | Johnson et al. | 36/29 |
| 4,449,307 | 5/1984 | Stubblefield | 36/29 |
| 4,472,890 | 9/1984 | Gilbert | 36/29 |

FOREIGN PATENT DOCUMENTS

| | | | |
|---|---|---|---|
| 806647 | 4/1951 | Fed. Rep. of Germany | 36/29 |
| 2800359 | 7/1979 | Fed. Rep. of Germany | 36/28 |
| WO79/00210 | 4/1979 | PCT Int'l Appl. | 36/29 |

*Primary Examiner*—Werner H. Schroeder
*Assistant Examiner*—Steven N. Meyers
*Attorney, Agent, or Firm*—Hopgood, Calimafde, Kalil, Blaustein & Judlowe

[57] ABSTRACT

The invention contemplates a shock-absorbing shoe sole which provides adjustably inflated pneumatic support at the rear half of the sole, and a graduated reduction of shock-absorbing from the inflated support region, to a forefoot-support region of minimum compliant yieldability. The construction involves two separate parts, one of which is molded with surface configurations to confront the other part, and the graduated-support action derives from bonding these two parts to each other, with an inflatable bladder substantially conforming to and deriving peripherally confining restraint from at least one such surface configuration. In one embodiment, a removable in-sole panel provides access for repair and/or replacement of the inflatable bladder.

18 Claims, 14 Drawing Figures

FIG. 8.
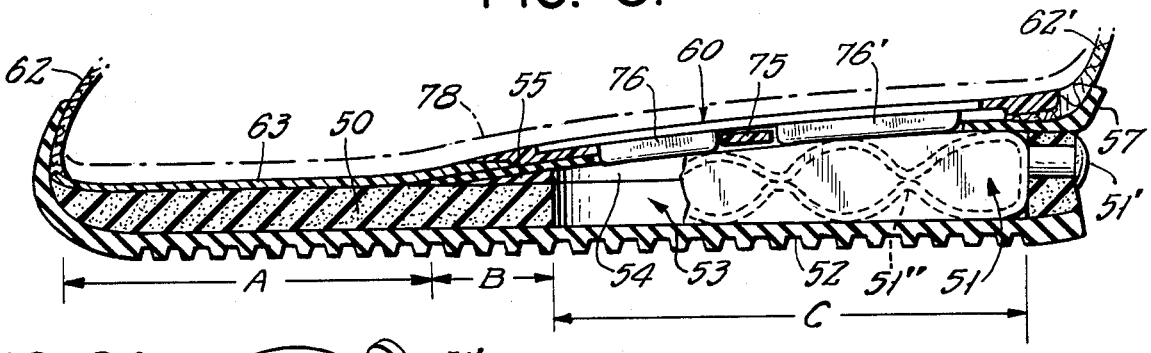
FIG. 8A.
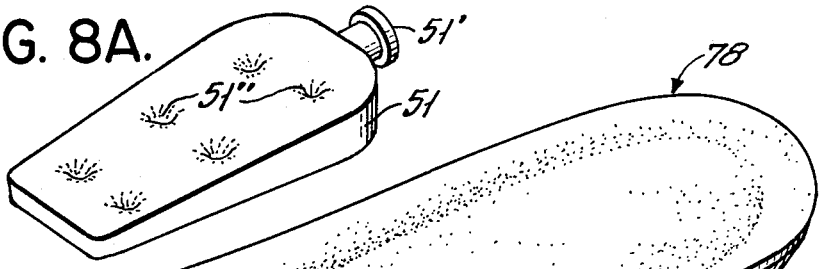
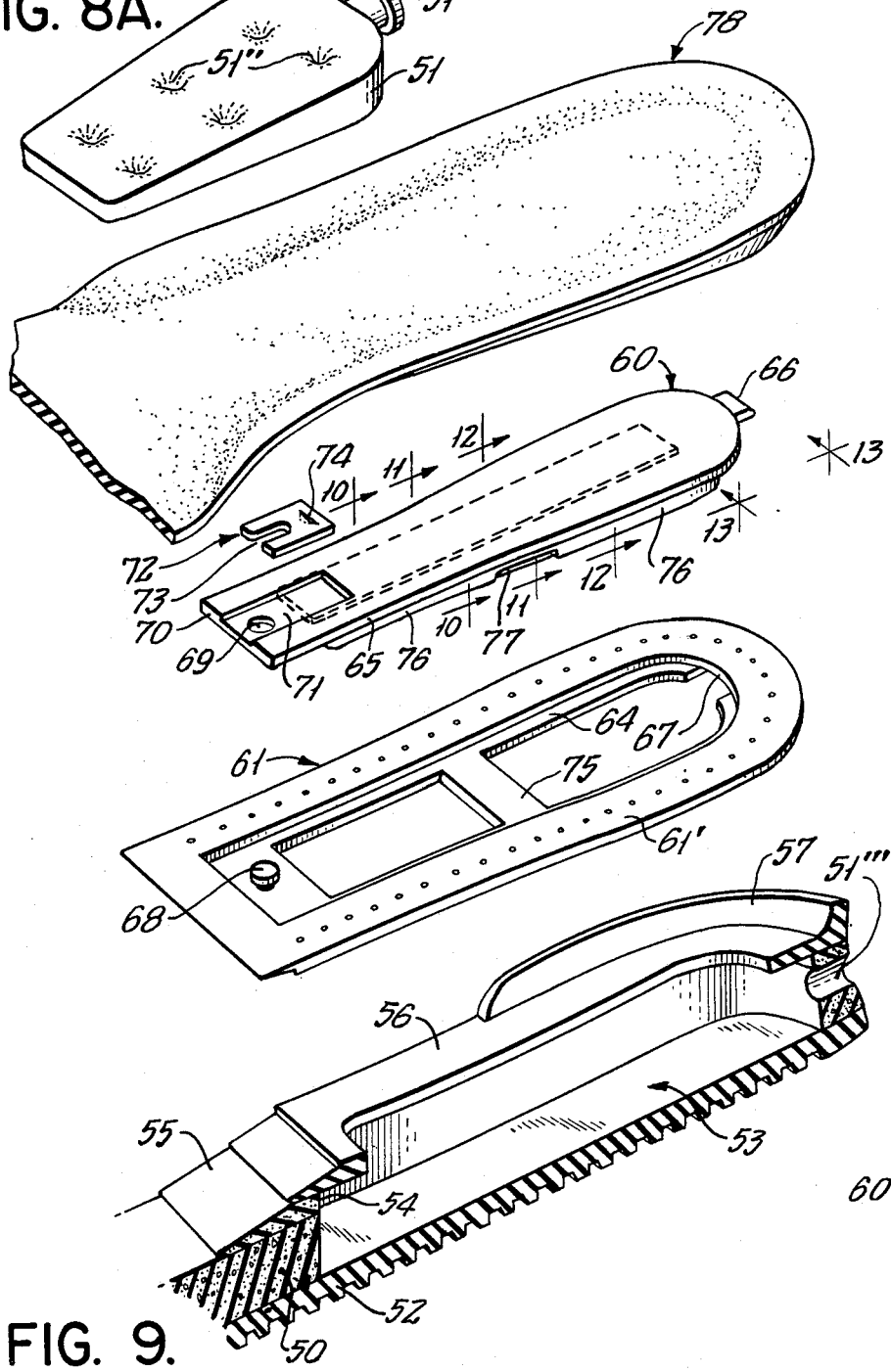
FIG. 9.
FIG. 10.
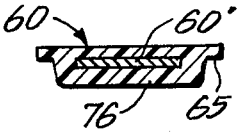
FIG. 11.
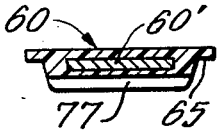
FIG. 12.
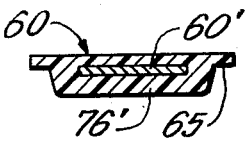
FIG. 13.
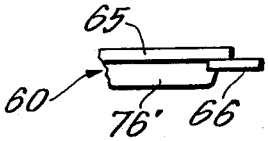

SHOCK-ABSORBING SHOE CONSTRUCTION

RELATED CASE

This application is a continuation-in-part of copending application Ser. No. 599,185, filed Apr. 9, 1984 now abandoned.

BACKGROUND OF THE INVENTION

The invention relates to a shock-absorbing shoe construction, particularly applicable to light-weight athletic shoes of the general variety popularly known as sneakers.

Foot comfort for the athlete and for those who jog or walk briskly for general exercise has been the target of many and varied proposals for shoe construction. And the broad concept of using a pneumatic cushion as part of the heel and/or sole construction has been known for the better part of a century, illustratively through King U.S. Pat. Nos. 541,814 of 1895 and Maddocks 1,011,460 of 1911. In more recent years, efforts have been directed to providing substantially uniformly absorbent action along the full length of the foot, either by employing specially fabricated pneumatic sheet material (as in Sindler U.S. Pat. 2,100,492), or by incorporating a full-length inflatable bladder in the sole (as in Reed U.S. Pat. Nos. 2,677,904 and in Cortina 2,863,230), or by providing an outsole with a substantially uniform distribution of air-filled cavities over the full area of the sole (as in Gardner U.S. Pat. Nos. 4,012,855, Petrosky 4,129,951, Khalsa, et al. 4,133,118, Moss 4,170,078, and Doak 4,397,104), or by providing a tread characterized by a distributed plurality of resilient "posts" served by interconnecting channels and a common source of pneumatic pressure (as in Muller U.S. Pat. No. 4,319,412). European Pat. No. 0,032,084 and German Provisional Patent Offenlegungsschrift No. OS 2,460,034 are illustrative of various arrangements to so construct the sole as to enable pneumatic preloading of all or selected regions of the foot.

These more recent structures are unduly complex, and they do not recognize or provide for the kind of distributed shock-absorbing resilience which is needed for alternating or intermittent jog/walk exercise.

BRIEF STATEMENT OF THE INVENTION

It is an object of the invention to provide an improved shoe construction of the character indicated, offering maximum comfort for both jogging and walking modes of use of the same shoe.

A specific object is to provide a shoe construction wherein shock-absorbing pneumatic action is to different degree, as a function of location along the length of the shoe, progressing from near-zero absorbance at the forefoot region, and achieving selectively variable maximum absorbance throughout substantially the rear half of the shoe.

Another specific object is to achieve the above objects with essentially simple structure, lending itself to inexpensive mass-production.

A further object is to provide a shoe construction meeting the above objects and affording relatively simple access for repair and/or replacement of a damaged bladder.

The invention achieves the foregoing objects with what amounts to a two-part sole configuration, wherein the first or upper part is the flexible bottom panel of a subassembly with shoe-upper structure, and wherein the second or lower part is formed to characterize the upper layer or lining of the tread of the shoe. The characterizing establishes (1) a first zone in the form of a large upwardly open pocket with peripheral sidewalls and an internal wall at substantially the midsection of the shoe, (2) a second or forefoot zone which is essentially void-free and which is offset from the first zone, and (3) an intermediate or transition zone of plural upwardly open pockets, between the first and second zones. An inflatable bladder conforms generally to walls of the large pocket and has valve and tube access through the heel part of the sidewall, for inflation purposes. And the flexible bottom panel of the shoe-upper subassembly includes a removably secured part which provides access for repair and/or replacement of the bladder.

DETAILED DESCRIPTION OF THE INVENTION

The invention will be described in detail for a preferred embodiment, in conjunction with the accompanying drawings, in which:

FIG. 8 is a longitudinal sectional view, primarily of the assembled sole of a modified shoe of the invention, with the bladder component thereof installed;

FIG. 8A is a perspective view on a reduced scale, to show the bladder component of FIG. 8;

FIG. 9 is a fragmentary exploded view in perspective, to illustrate separably related parts to enable servicing and/or replacement of the bladder component;

Figure 1:
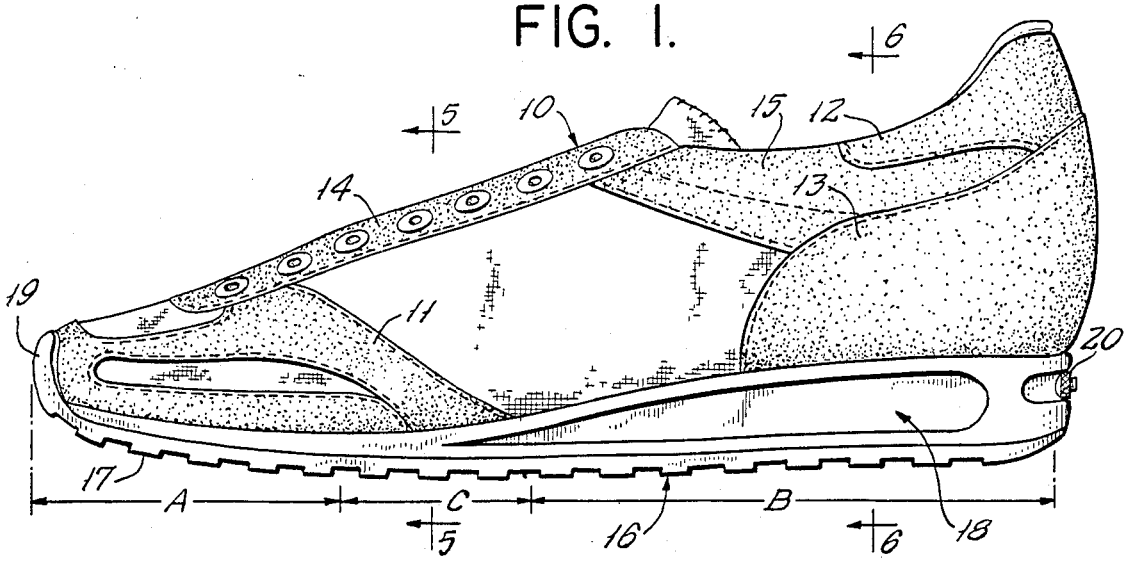
FIG. 1 is a side view in elevation of a shoe embodying the invention.

FIGS. 10, 11, and 12 are similar transverse sectional views, taken at the respective longitudinal locations 10—10, 11—11, and 12—12 of a removable panel of FIG. 1; and FIG. 13 is a fragmentary view in elevation, taken from the aspect 13—13 of FIG. 9.

Figure 7:
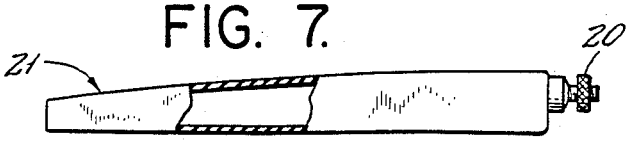
FIG. 7 is a partly broken-away side view of a bladder component of the shoe of FIG. 1.

In FIG. 1, a shoe which illustratively embodies the invention is seen to comprise a light-weight upper 10 of woven synthetic fiber with externally sewn leather or leather-like reinforcements 11 in and around the toe region and at 12-13 in the heel region; further such reinforcements are provided at 14 for lacing eyelets, and at 15 to complete the reinforced integrity of the top of the shoe. The sole 16 extends the length of the shoe, being thinnest at the forefoot region and rising gradually thorugh the arch to a well-elevated heel region. The sole is characterized (1) by substantially no compliant yieldability, but relatively great flexibility, at the forefoot region, designated A, (2) by maximum compliant yieldability (and essentially no flexibility) throughout substantially the rear half of the shoe, designated B, and (3) by progressively increasing compliant yieldability (and reducing flexibility) in a transition zone C which interconnects regions A and B. A cleated tread 17 characterizes the underside of sole 16, and a rising peripheral sidewall 18 is an integral formation of the sole, throughout regions B and C; in FIG. 4, the cleated underside of the sole is seen to be a feature of a lower ply which extends the full length of the sole and which includes a cap or toe-lapping formation 19 secured around the toe of upper 10. Finally, to complete the description of FIG. 1, a pneumatic-inflation fitting 20, which is part of an internally captive elastomeric bladder 21 (see FIG. 7), projects through a limited opening in sidewall 18, at the heel.

Figure 3:
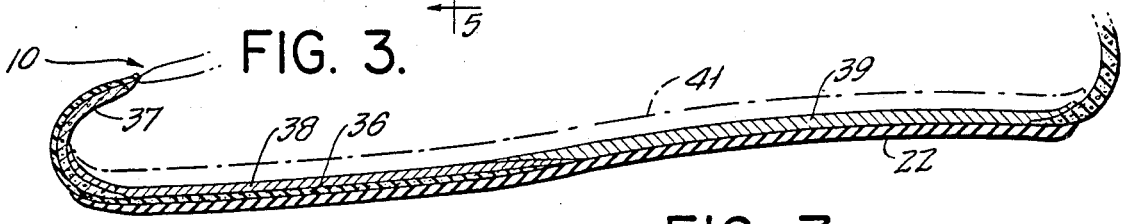
FIG. 3 is a fragmentary longitudinal sectional view of the lower region of shoe-upper structure, in readiness for assembly to shoe-sole structure of FIG. 2.

In accordance with a feature of the invention, the upper 10 is a subassembly having a bottom-surface layer 22 (see FIG. 3) of elastomeric material. In manufacture of the shoe, layer 22 is bonded to structural contours of the molded elastomeric upper surface or layer 23 of sole 16 (see FIG. 4), it being noted that peripheral sidewalls 18 are integral formations of the molded layer 23.

Figure 2:
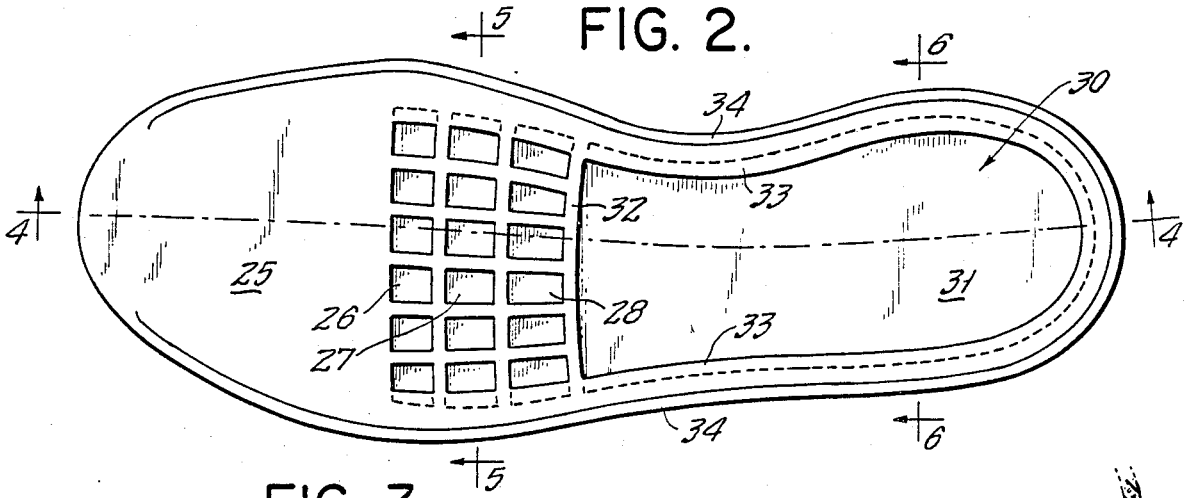
FIG. 2 is a plan view of a molded component of the sole of the shoe of FIG. 1.

More particularly, the molded layer 23 is viewed in plan in FIG. 2 and comprises a thin solid area 25 at the forefoot region A. In approach to intermediate region C, the thickness of area 25 builds for smooth transition to the rising profile of intermediate region C. Region C is characterized by a cluster of upwardly open generally rectangular pockets 26-27-28 of progressively increasing vertical extent. In the rear zone C, a single large upwardly open pocket 30 is defined by a thin bottom panel 31, by sidewalls 18 rising therefrom, and by the generally central internal wall 32 at which zones B and C are adjacent. For purposes of well-seated assembly to and support of the shoe-upper subassembly 10, the sidewall section features an integral upper flange 33 which extends inwardly and is preferably further characterized by a short outer rib 34. This flange 33 and rib 34 feature of the sidewall section is shown at the heel (FIG. 4), across the region B of the large pocket 30 (FIG. 6), and across the intermediate region C of clustered pockets (FIG. 5). In other words, the support afforded by flange 33 extends peripherally and continuously through all zones and reduces to zero near the toe end of zone A. The only interruption in continuity of sidewall 18 is at the heel, where a local opening 35 and adjacent recess in the web of the sidewall section are configured to receive bladder 21 and its inflation-valve fitting 20.

In preparation for assembly of the shoe of FIG. 1, the upper assembly 10 will first have been completed, to the point of consolidating various lining laminations to the elastomeric bottom layer 22. Specifically, the regions A and C of layer 22 are lined with and bonded to a thin slightly cushioning layer 36 of expanded flexible plastic sheet, such as an expanded urethane, with layer 36 extending forwardly and up around the front of the toe. Toe protection is further enhanced by another layer 37 of expanded plastic material bonded to and lining the toe region of layer 36; and a relatively thin panel 38 of more stiffly flexible felt or fiber board, with feathered ends and edges, is bonded to layer 36 and is thus laminated to layers 22 and 36 in regions A and C. In addition, a second but substantially thicker panel 39 of stiff and relatively inflexible felt or fiber board, also with feathered ends and edges, is laminated to layer 22 in region B, with feathered-end overlap into region C, and over the feathered end of panel 38. Preferably, the described laminations of the bottom of the upper assembly 10 are peripherally stitched in the feathered-edge areas, to assure retention of all lamination bonding.

Further assembly proceeds by taking the molded elastomeric part 23 and inserting bladder 21 in pocket 30, with the nut of the inflation fitting 20 tightly set to clamp the same across the sidewall opening 35. After first applying a coat of adhesive over the entire exposed bottom surface of layer 22, the upper subassembly is so applied to the molded part 23 that peripheral margins of panel 22 seat securely on flange areas 33, within and located against the peripheral rib 34, it being understood that, at the toe end, flange areas 33 will have merged with the thin surface of the molded part 23, and that in the presence of clamp action to promote full bonding, the panel 22 will also have bonded to upper edges of dividers between pockets 26-27-28, thus sealing off all of these pockets.

Having bonded molded part 23 to the upper subassembly, the tread panel 17 of the sole is similarly applied in bonded registry with the smooth underside of part 23. In this connection, it is helpful to inflate bladder 21 while allowing adhesive to cure in a clamped application of tread panel 17. At the toe end, tread panel 17 is in bonded overlap with the toe end of the upper 10, and a dashed line 40 in FIG. 4 will be understood to designate a region and orientation for riveted fastening of the tip end of tread panel 17 to the reinforced top of upper 10.

Figure 4:
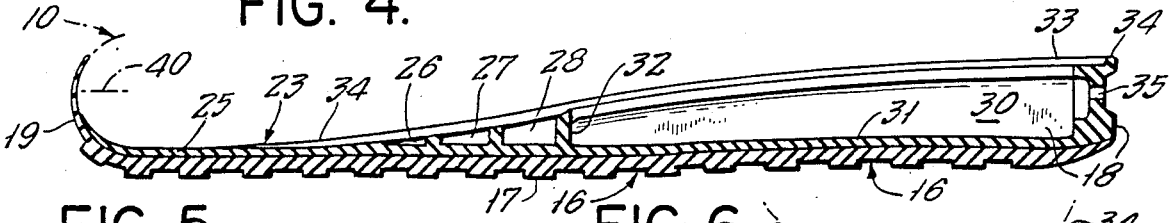
FIG. 4 is a longitudinal sectional view of the sole structure of FIG. 2, taken on the alignment 4—4 of FIG. 2.
Figure 5:
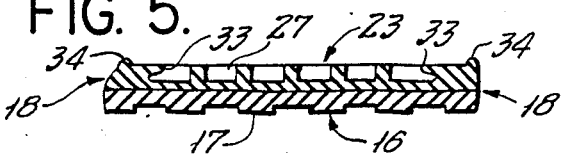
FIGS. 5 and 6 are sectional views, respectively taken at 5—5 and at 6—6 in FIG. 2.

Detail of construction of upper 10 has been omitted as being irrelevant to the sole construction of the invention, but a preference is indicated to complete the shoe by insertion of a molded cushion insole, suggested by phantom outline 41 in FIG. 4.

Figure 6:
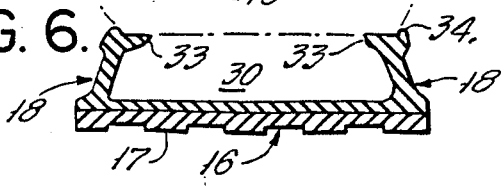

The described shoe construction will be seen to achieve all stated objects. Firm forefoot support is via the region A of greatest importance to the jogger. Progressive compliant yieldability in the intermediate zone assures the jogger against shock other than to the forefoot, even when jogging on uneven or gravelly surfaces. On the other hand, the energetic walker can adjust the shock-resisting and support properties of the region B to suit his comfort and style, and the progressive cluster of sealed pockets 26-27-28 in zone C provides a comfortable transition of compliant support, down to the firm-footed feeling which derives from minimum cushioning of forefoot support. The relative inflexibility of plate 39, which fully spans region B and receives direct load-bearing support from inner wall 32, assures against any "mushy" feeling or action within region B. Finally, the inwardly canted nature of sidewalls 18, as best seen in FIG. 6, contributes to the firm-footed feel of the shoe, in that sidewall deflection under load is characterized by a laterally inward thrust from both sides, thus contributing to foot-positioning stability.

In the embodiment of FIGS. 8 to 13, a relatively short intermediate zone B provides transition of compliant action, from a forefoot region A of relatively firm support via a continuous layer 50 of slightly foamed rubber, to the controllable compliance provided by a bladder 51, for the longitudinal extent of a heel region C. A single molded elastomeric tread panel constitutes the bottom layer 52, and the firmly compliant layer 50 extends the full length of the shoe, being bonded to layer 52 and cut out in the region C to provide peripherally continuous sidewall definition of the large elongate pocket 53 which contains, locates, and laterally buttresses bladder 51, when inflated. As shown, an additional layer 54, which may be of the same material and/or piece as layer 50, overlaps regions B and C and is cut to the profile of pocket 53; layer 54 elevates the heel region C with respect to the forefoot region A and is downwardly ramped or feathered at 55 to provide the indicated transitional compliance in region B. An apertured plate 56 of relatively stiff material is seen in the lower part of FIG. 9 to complete subassembly of shoe-sole structure, plate 56 being peripherally continuously bonded to the elevating layer 54; plate 56 is shown to be of a suitable plastic and to include an upstanding flange portion 57 which skirts the back of the heel, extending longitudinally forward on both sides of the heel, for approximately half the longitudinal extent of pocket 53.

The bladder 51 peripherally conforms to the peripheral inside wall of pocket 53 and is seen in FIGS. 8 and 8A to feature upper and lower panels which are locally bonded or tufted at longitudinally and laterally spaced points 51'' so as to avoid any tendency to balloon when pressurized. It is clear that bladder 51 may also be used, as an alternative, in place of the bladder 21 in the embodiment of FIGS. 1 to 7.

In accordance with a feature of the invention, the pocket 53 is accessible for repair and/or replacement of bladder 51, via a panel 60 which is removably retained in reference to inner sole structure of the shoe. In the form shown, a plate 61 is configurated with a relatively wide rim 61' which continuously surrounds a central opening for access to pocket 53. Plate 61 is relatively stiff and is perforated near its outer margin, for stitched incorporation into a subassembly of shoe-upper structure. The remainder of shoe-upper structure is unimportant to the invention and is therefore not shown in detail; however, pertinent fragments of the toe and heel ends of the shoe-upper structure are suggested at 62—62' in FIG. 8, with a thin flexible inner panel 63 lapping regions A and B of the sole subassembly, and plate 61 lapping region C and a part of region B. When the two subassemblies are bonded to each other, plate 61 will be understood to derive peripherally continuous support from plate 56, and shoe-upper structure at 62' will be seen to derive well-nested locating support via skirt formation 57.

More specifically, and as best shown in FIG. 9, the inner edge which defines the access opening of plate 61 is rabbeted to provide a virtually peripherally continuous flange 64 upon which a peripherally continuous flange 65 of panel 60 may seat. The thickness of flange 65 and the depth of the rabbeted edge are the same, so that in seated assembly to plate 61, the upper surfaces of panel 60 and of plate 61 will be flush.

Interengaging formations of panel 60 and plate 61 are at the respective longitudinal ends of pocket 53 and are such as to enable a degree of upwardly arched compliant response to upward force from a bladder 51; and a steel core strip 60' embedded in panel 60, and almost longitudinally coextensive therewith, stiffens this response. At the heel end, the interengaging formations comprise a longitudinally projecting integral lug 66 (see FIGS. 9 and 13) of panel 60, engaging through a slot 67 in the flange 64 of plate 61 and beneath the rim thereof. At the engageable forward end, these formations comprise (a) an upstanding thinly headed stud 68, the top surface of which is substantially in the geometrical plane of the nearby upper surface of the rim of plate 61, and (b) the aperture 69 of a tongue-like projection 70 of panel 60. The aperture 69 is in a locally recessed region 71 of tongue 70 and removably accommodates through-passage of the head of stud 68. A thin clip 72 is slidable within recess 61 to permit its slotted end 73 to engage under the head of stud 68, to thus retain panel (60) assembly to plate 61; a local fingernail recess 74 in clip 72 facilitates manipulative access, to actuate clip 72 out of retaining engagement to stud 68, thus releasing the forward end of panel 60, for upward hinging about the point of heel engagement at 66/67, in the course of removing panel 60. At this point, access is direct to bladder 51, which is relatively soft and flexible, even at the outer flange 51' of its inflation device, so that the entire bladder can be extracted from its pocket, when desired.

FIG. 9 illustrates a preference that in view of the elongate configuration of the central opening of plate 61, this opening shall be locally retained by a narrow integral transverse bridge member 75, thus assuring against any outward bulging of the elongate sides of plate 61. Bridge 75 thus precisely retains flange 64 in supporting relation with the panel flange 65. Bridge 75 is preferably located in the longitudinally central region of panel 60, i.e., central in respect of the longitudinal end connections of panel 60 to plate 61. And in the access-opening regions on either longitudinal side of bridge 75, panel 60 is stiffened by extra thickness (at 76 and 76', respectively); also, the thickness of panel 60 is centrally reduced by a transverse groove 77 in its lower surface, for enhanced central flexing action in response to cyclical body weight application against inflated-bladder pressure.

The embodiment of FIGS. 8 to 13 will be seen to provide substantially all the compliant-action features of the embodiment of FIGS. 1 to 7, with the additional feature of ready maintenance, through repair and/or replacement of the inflatable bladder. In both cases, the use of a cushioning in-sole insert (41 in FIGS. 1 to 7; 78 in FIGS. 8 to 13) is preferred. As seen in FIG. 9, such an insert (78) is desirably molded with an upstanding heel flange 79 for heel-stabilizing comformability. Such an insert (78) is self-stabilizing to innerwall contours of the shoe-upper structure and therefore requires no bonding. Bladder removal thus involves the simple steps of removing the insert (78), sliding clip 72 out of stud (68) engagement, lifting tongue 70, and removing panel 60 to gain direct access. If, as is currently preferred, the check-valve action at the bladder inflation device is entirely via elastomeric resilience (as in inflated football constructions), an inflated bladder 51 can be readily deflated by hypodermic needle insertion at the inflation device, followed by finger pressure via the access opening, which was gained by removal of panel 60. It is then possible to manipulate bladder 51, as by pinched-finger grip, pulling the inflation device inwardly through its access port 51''' at the heel end of the base layer 50. To load a new repaired bladder 51 back into the pocket 53, a string should first be passed through access port 51''' then tied to the inflation-device end of the bladder 51. While pulling the string, the bladder is flexed as necessary to bring it under bridge 75, finally pulling the inflation device end through port 51''', at which point the string connection can be severed or untied. Panel 60 is then assembled by inserting lug 66 in slot 67 and then hinging the same down into stud (68) engagement through tongue aperture 69, whereupon the connection is retained by sliding the slot of clip 72 under the head of stud 68. The insert 78 is slipped into position and inflation pressure delivered to the bladder, as by pumped delivery of air at 51'.

Although the invention has been described in detail for preferred embodiments, it will be understood that modifications may be made without departing from the scope of the invention. And it should be clear that the feature of the removable panel 60 is equally applicable to other shoe-cushioning configurations including that of FIGS. 1 to 7.

What is claimed is:

1. A shoe having a sole characterized by a first or forefoot region of relatively low compliant yieldability, and a second or heel region of relatively great compliant yieldability; said heel region comprising a single pocket defined (1) by flexible upper and lower panels extending for substantially the rear half of the sole and (2) by peripheral sidewalls including an internal wall at an intermediate region of the sole, an inflatable bladder retained within said pocket and conforming to adjacent surfaces of said walls and panels, said bladder having an inflation device including a check valve and projecting for external access through one of said sidewalls, and said upper panel comprising a stiffly compliant plate peripherally secured to said sidewalls and centrally open for access to said bladder, said upper panel further including means providing removable closure of the opening in said plate, whereby to provide maintenance and/or replacement access to said bladder.

2. The shoe of claim 1, in which said plate integrally includes a relatively narrow bridge connecting the sides of the opening at the longitudinal central region of the opening.

3. The shoe of claim 2, in which the opening of said plate is characterized by a rabbeted edge, and in which said means providing removable closure is a panel member characterized by a peripheral flange that is contoured for seated reception at said rabbeted edge such that said panel member, when seated, derives substantially continuous peripheral support from said plate.

4. The shoe of claim 3, in which the upper surface of said panel member, when seated, is flush with the upper surface of said plate.

5. The shoe of claim 3, in which said panel member and plate include detachably engageable formations at each of the longitudinal ends of the opening, said engagements being resistive of vertical displacement of the longitudinal ends of said panel member, and said panel member being otherwise free to yield in upwardly arching compliant response to support by said bladder, when inflated.

6. The shoe of claim 5, in which, at one of said longitudinal ends, said detachably engageable formations comprise a longitudinally projecting lug formation of said panel member and a lug-receiving recess of said plate.

7. The shoe of claim 5, in which, at one of said longitudinal ends, said detachably engageable formations comprise an upstanding headed stud carried by said plate and a longitudinally projecting tongue formation of said panel member, said tongue formation having an aperture for through-reception of said stud, and a thin removable clip having a slotted edge removably receivable under the head of said stud.

8. The shoe of claim 5, in which the upper surface of said tongue formation is recessed in the region of said aperture, the recessed depth being sufficient to accommodate the headed end of the stud and said clip substantially within the geometrical continuum of the upper surface of said tongue formation.

9. The shoe of claim 1, in which said panel member is characterized by greatest thickness in the region contained within the plate opening, subject to at least one relatively narrow transverse groove in the lower surface of said panel member at a longitudinally intermediate region of said panel member, whereby compliant upward arching of said panel member is facilitated.

10. The shoe of claim 2, in which said bladder comprises substantially coextensive upper and lower panels that are peripherally connected along a contour in general conformance with the side wall contour of said pocket, and at least one tufted local interconnection of said bladder panels within and spaced from their peripheral connection.

11. A shoe having a sole characterized by a first or forefoot region of relatively low compliant yieldability, a second or heel region of relatively great compliant yieldability, and a transitional intermediate region between said first and second regions; said heel region comprising a single pocket defined (1) by flexible upper and lower panels extending for substantially the rear half of the sole and (2) by peripheral sidewalls including an internal wall at juncture with said intermediate region, a single inflatable bladder retained within said pocket and peripherally conforming generally to adjacent surfaces of said walls and panels, said bladder having an inflation device including a check valve projecting for external access through one of said sidewalls, said inflation device being the only means of pressurizing-gas delivery to and retention within said bladder; said forefoot region comprising stiffly flexible and relatively void-free material; and said upper panel being a removably fitted part of said sole, whereby to provide maintenance and/or replacement access to said bladder.

12. A shoe having a sole characterized by a first or forefoot region of relatively low compliant yieldability, a second or heel region of relatively great compliant yieldability, and a transitional intermediate region between said first and second regions; said heel region comprising a single pocket defined (1) by flexible upper and lower panels extending for substantially the rear half of the sole and (2) by peripheral sidewalls including an internal wall at juncture with said intermediate region, a single inflatable bladder retained within said pocket and peripherally conforming generally to adjacent surfaces of said walls and panels, said bladder having an inflation device including a check valve projecting for external access through one of said sidewalls, said inflation device being the only means of pressurizing-gas delivery to and retention within said bladder; said forefoot region comprising stiffly flexible and relatively void-free material; and said intermediate region comprising a distributed cluster of sealed pockets.

13. The shoe of claim 12, in which a stiffly compliant plate secured to and over the area of said upper wall extends forward into at least partial overlap with said intermediate region.

14. The shoe of claim 12, in which the sealed-pocket region is characterized by progressively increasing compliant yieldability in the direction of approach to said internal wall.

15. The shoe of claim 12, including a shoe upper secured to said sole; said sole comprising a first elastomeric part in the form of a smooth bottom-surface panel of the shoe upper and united thereto as a subassembly; said sole further comprising a molded elastomeric lower part having a continuous bottom and a characterized upper surface which (1) is relatively thin and compressionally non-compliant in said first region, (2) integrally includes said peripheral sidewalls upstanding from the continuous bottom, said walls extending peripherally at least around the second and intermediate regions, with faired merger into the bottom at said first region, and (3) comprises a plurality of upwardly open pockets within said intermediate region; said bottom-surface panel of the shoe upper being bonded to the characterized upper surface of said molded lower part in all said regions to close said pockets.

16. The shoe of claim 15, in which said molded part has a smooth lower surface, and in which a molded tread panel with a smooth upper surface is bonded to said smooth lower surface.

17. The shoe of claim 15, in which the depth of said upwardly open pockets increases progressively throughout said intermediate zone in the direction toward said heel region.

18. A shoe having a sole characterized by a first or forefoot region of relatively low compliant yieldability, a second or heel region of relatively great compliant yieldability, and a transitional intermediate region between said first and second regions; said heel region comprising a single pocket defined (1) by flexible upper and lower panels extending for substantially the rear half of the sole and (2) by peripheral sidewalls including an internal wall at juncture with said intermediate region, a single inflatable bladder retained within said pocket and peripherally conforming generally to adjacent surfaces of said walls and panels, said bladder having an inflation device including a check valve projecting for external access through one of said sidewalls, said inflation device being the only means of pressurizing-gas delivery to and retention within said bladder; said forefoot region comprising stiffly flexible and relatively void-free material; and said intermediate region being characterized by a distributed plurality of sealed pockets providing transitional compliant action between the first or forefoot region and the second or heel region.

* * * * *